US009091964B2

(12) United States Patent
Miyazaki

(10) Patent No.: US 9,091,964 B2
(45) Date of Patent: Jul. 28, 2015

(54) ELECTROPHOTOGRAPHIC IMAGE FORMING APPARATUS

(71) Applicant: Oki Data Corporation, Minato-ku, Tokyo (JP)

(72) Inventor: Yoshitaka Miyazaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/032,306

(22) Filed: Sep. 20, 2013

(65) Prior Publication Data

US 2014/0086604 A1 Mar. 27, 2014

(30) Foreign Application Priority Data

Sep. 26, 2012 (JP) ..... 2012-212868

(51) Int. Cl.
*G03G 15/00* (2006.01)
*G03G 15/16* (2006.01)

(52) U.S. Cl.
CPC ..... *G03G 15/16* (2013.01); *G03G 15/1605* (2013.01); *G03G 15/1675* (2013.01)

(58) Field of Classification Search
CPC ..... G03G 15/1675
USPC ..... 399/45, 66
See application file for complete search history.

(56) References Cited

U.S. PATENT DOCUMENTS 4,415,254 A * 11/1983 Nishikawa ..... 399/314
2004/0047641 A1* 3/2004 Kato et al. ..... 399/45
2012/0051773 A1 3/2012 Takahashi

FOREIGN PATENT DOCUMENTS

JP 2012-053085 A 3/2012

* cited by examiner

*Primary Examiner* — Walter L Lindsay, Jr.
*Assistant Examiner* — Ruth Labombard
(74) *Attorney, Agent, or Firm* — Panitch Schwarze Belisario & Nadel LLP

(57) ABSTRACT

An image forming apparatus includes an image forming unit, an image carrier carrying on a surface thereof a developer image formed by the image forming unit, a transfer unit for transferring the developer image carried on the image carrier to a recording medium, a voltage supplying unit for supplying a transfer voltage to the transfer unit, a transfer current measuring unit for measuring a transfer current value at a time that a prescribed voltage is applied from the voltage supplying unit to the transfer unit in a state that no recording medium exists in the transfer unit, a resistor serially coupled between the transfer current measuring unit and the transfer unit, a memory unit for memorizing electrical character information of the recording medium, and a controller for controlling the transfer voltage supplied from the voltage supplying unit to the transfer unit where the developer is transferred to the recording medium, based on a consequence measured by the transfer current measuring unit, a recording medium width in a widthwise direction in association with the kind of the recording medium, the electrical character information, and a resistance value of the resistor, to precisely adjust a secondary transfer current value.

20 Claims, 16 Drawing Sheets

110

| RECORDING MEDIUM WIDTH (mm) | SW 109a | SW 109b | SW 109c | SW 109d |
|---|---|---|---|---|
| 210～220 | 0 | 0 | 0 | 0 |
| 200～210 | 1 | 0 | 0 | 0 |
| 190～200 | 0 | 1 | 0 | 0 |
| 180～190 | 1 | 1 | 0 | 0 |
| 170～180 | 0 | 0 | 1 | 0 |
| 160～170 | 1 | 0 | 1 | 0 |
| 150～160 | 0 | 1 | 1 | 0 |
| 140～150 | 1 | 1 | 1 | 0 |
| 130～140 | 0 | 0 | 0 | 1 |
| 120～130 | 1 | 0 | 0 | 1 |
| 110～120 | 0 | 1 | 0 | 1 |
| 100～110 | 1 | 1 | 0 | 1 |
| 90～100 | 0 | 0 | 1 | 1 |
| 80～90 | 1 | 0 | 1 | 1 |
| 70～80 | 0 | 1 | 1 | 1 |
| 60～70 | 1 | 1 | 1 | 1 |

SW OFF＝0

FIG.12

120

UNIT : μ A/mm

| | | HUMIDITY [%] | | | | |
|---|---|---|---|---|---|---|
| | | ~20 | 20~40 | 40~60 | 60~80 | 80~ |
| TEMPERATURE [°C] | ~10 | 0.16 | 0.15 | 0.14 | 0.13 | 0.12 |
| | 10~20 | 0.15 | 0.14 | 0.13 | 0.12 | 0.11 |
| | 20~30 | 0.14 | 0.13 | 0.12 | 0.11 | 0.10 |
| | 30~ | 0.13 | 0.12 | 0.11 | 0.10 | 0.09 |

FIG.13

121

UNIT : kV

| | | HUMIDITY [%] | | | | |
|---|---|---|---|---|---|---|
| | | ~20 | 20~40 | 40~60 | 60~80 | 80~ |
| TEMPERATURE [°C] | ~10 | 1.20 | 1.05 | 0.90 | 0.75 | 0.60 |
| | 10~20 | 1.05 | 0.90 | 0.75 | 0.60 | 0.45 |
| | 20~30 | 0.90 | 0.75 | 0.60 | 0.45 | 0.30 |
| | 30~ | 0.75 | 0.60 | 0.45 | 0.30 | 0.15 |

ELECTROPHOTOGRAPHIC IMAGE FORMING APPARATUS

CROSS REFERENCE TO RELATED APPLICATION

This application claims priority benefits under 35 USC, section 119 on the basis of Japanese Patent Application No. 2012-212868 filed Sep. 26, 2012, the disclosure of which is incorporated herein by reference.

BACKGROUND OF THE INVENTION

1. Field of the Invention

This invention relates to an image forming apparatus and, more particularly, to an image forming apparatus using, e.g., an electrophotographic method for forming images by transferring toner images formed on an image carrier to a transfer material.

2. Description of Related Art

Electrophotographic multicolor printers of an intermediate transfer type, conventionally form images by overlapping toner images formed on respective photosensitive drums corresponding to respective colors in, e.g., black (K), yellow (Y), magenta (M), and cyan (C) to an image carrier (or an intermediate transfer body) upon transferring the toner images as a primary transfer and subsequently by transferring the toner images carried on the image carrier onto a recording medium again as a secondary transfer.

Japanese Patent Application Publication No. 2012-053085 discloses arts on electrophotographic multicolor printers of the intermediate transfer type. In such a prior art electrophotographic multicolor printer of the intermediate transfer type, respective primary transfer rollers are disposed in contact with respective photosensitive drums corresponding to respective colors in, e.g., black (K), yellow (Y), magenta (M), and cyan (C) via an intermediate transfer belt serving as an image carrier, for forming a primary transfer nipping area. A transfer bias voltage having a polarity opposite to that of the toner images formed on the photosensitive drums is applied to the primary transfer rollers, thereby primarily transferring the toner images to the intermediate transfer belt.

A secondary transfer roller is disposed in facing the intermediate transfer belt to form a secondary transfer nipping area. A transfer bias voltage having a polarity opposite to that of the toner images on the intermediate transfer belt is applied to the secondary transfer roller, thereby transferring the toner images to a recording medium conveyed to the secondary transfer nipping area.

To obtain good secondary transfer consequences, it is required to control the transfer bias voltage applied to the secondary transfer roller to be in a suitable range. With such a prior art image forming apparatus, however, there arises a problem that the bias voltage cannot be suitably controlled in a case where the image forming apparatus makes printing on recording media in plural sizes and where the media have different widths in a direction perpendicular to a medium conveyance direction.

SUMMARY OF THE INVENTION

In consideration of such backgrounds, it is an object of the invention to provide an image forming apparatus operable with improved printing performances even where recording media have different sizes.

To solve the above problems, an image reading apparatus according to the invention includes an image forming unit, an image carrier carrying on a surface thereof a developer image formed by the image forming unit, a transfer unit for transferring the developer image carried on the image carrier to a recording medium, a voltage supplying unit for supplying a transfer voltage to the transfer unit, a transfer current measuring unit for measuring a transfer current value at a time that a prescribed voltage is applied from the voltage supplying unit to the transfer unit in a state that no recording medium exists in the transfer unit, a resistor serially coupled between the transfer current measuring unit and the transfer unit, a memory unit for memorizing electrical character information of the recording medium, and a controller for controlling the transfer voltage supplied from the voltage supplying unit to the transfer unit where the developer is transferred to the recording medium, based on a consequence measured by the transfer current measuring unit, a recording medium width in a widthwise direction in association with the kind of the recording medium, the electrical character information of the recording medium, and a resistance value of the resistor.

According to the image forming apparatus of the invention, printing operation is more easily controllable in comparison with conventional printers where recording media in plural sizes are subject to printing, even where the widths of the recording media are different.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings:

FIG. 12 is a table for medium current according to the first embodiment of the invention;

FIG. 13 is a table for medium voltage according to the first embodiment of the invention;

DETAILED DESCRIPTION OF EMBODIMENTS

First Embodiment

Hereinafter, an image forming apparatus according to the first embodiment of the invention is described in reference with drawings. In the first embodiment, exemplified is a multicolor image recording apparatus of an electrophotographic method using an intermediate transfer method.

Figure 1:
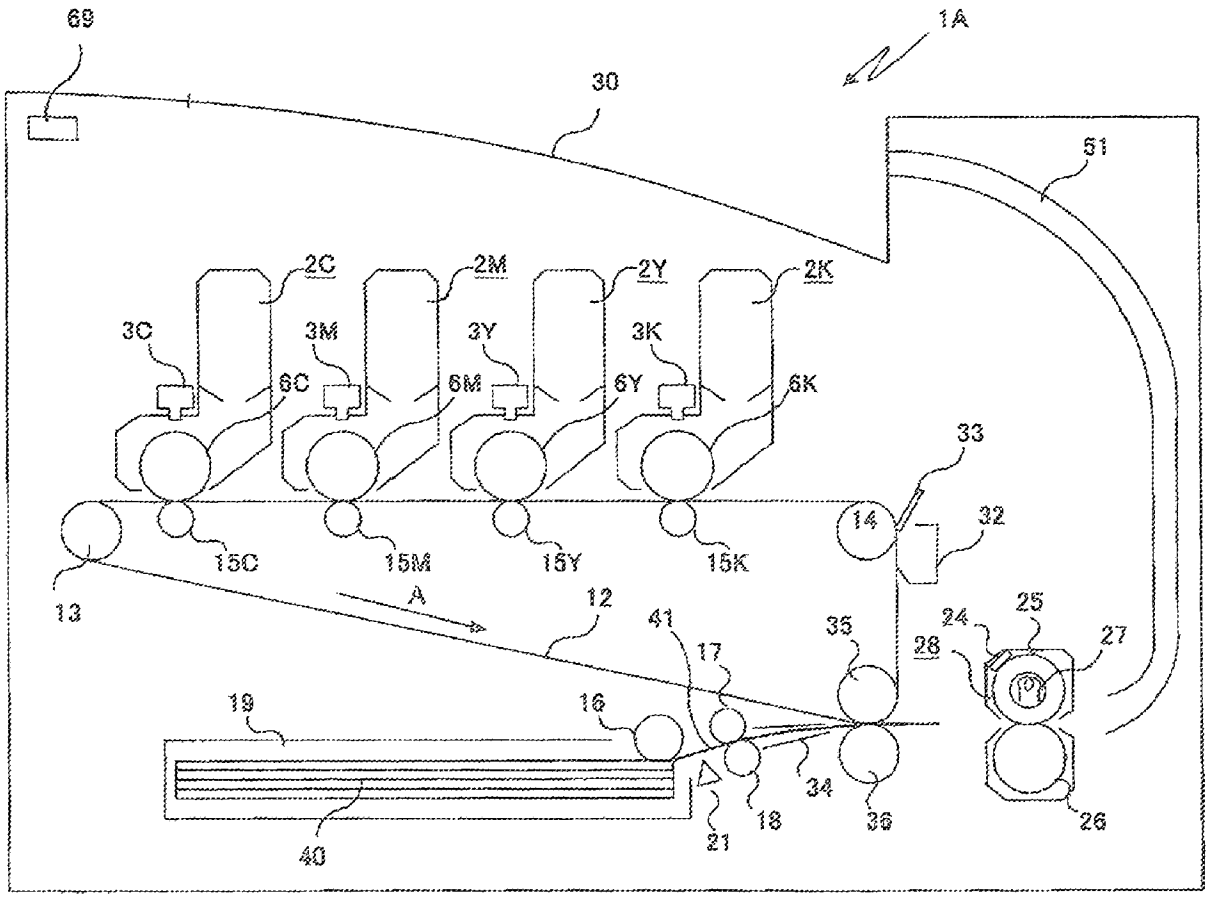
FIG. 1 is a schematic diagram showing an internal structure of a multicolor image recording apparatus according to a first embodiment of the invention.

FIG. 1 is a schematic diagram showing an internal structure of a multicolor image recording apparatus 1A according to the first embodiment of the invention.

In FIG. 1, the multicolor image recording apparatus 1A according to the first embodiment includes four image forming units 2K, 2Y, 2M, 2C serving as image forming units, an intermediate transfer belt 12 serving as an image carrier or intermediate transfer body, a drive roller 13, an idle roller 14, a secondary transfer backup roller 35, primary transfer rollers 15K, 15Y, 15M, 15C, a secondary transfer roller 36, a cleaning blade 33, a cleaner container 32, a recording medium containing cassette 19, a hopping roller 16, a registration sensor 21, a registration roller 17, a pinching roller 18, a guide member 34, a fixing device 28, a delivery guide member 51, and a temperature and humidity sensor 69.

Structures of the respective image forming units 2K, 2Y, 2M, 2C as the image forming unit, and the primary transfer unit, installed in the multicolor image recording apparatus 1A according to the first embodiment, are described first.

The multicolor image recording apparatus 1A has the four independent image forming units 2K, 2Y, 2M, 2C. The four image forming units 2K, 2Y, 2M, 2C make recording of images in black K, yellow Y, magenta M, cyan C, respectively, on the surface of the intermediate transfer belt 12.

The four image forming units 2K, 2Y, 2M, 2C are arranged in the order of image forming units 2K, 2Y, 2M, 2C from an upstream side in a rotation direction A of the intermediate transfer belt 12. The four image forming units 2K, 2Y, 2M, 2C are disposed so as to render photosensitive drums 6K, 6Y, 6M, 6C in contact with the surface of the intermediate transfer belt 12 serving as an image carrier.

Figure 2:
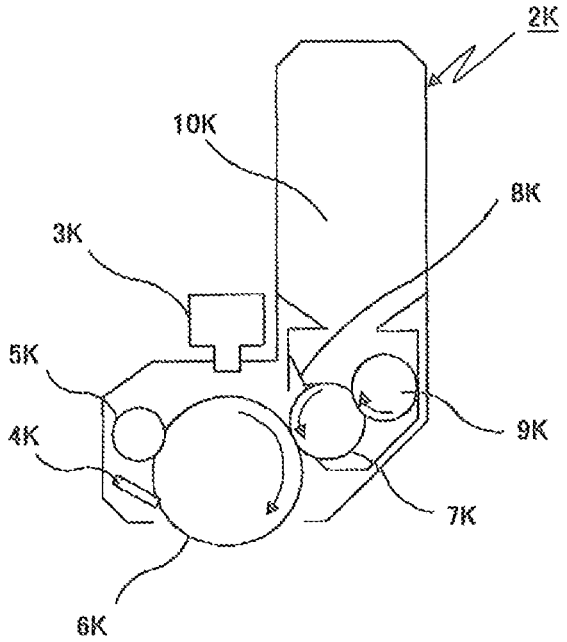
FIG. 2 is a schematic diagram showing an internal structure of respective image forming units 2K, 2Y, 2M, 2C according to the first embodiment of the invention.

FIG. 2 is a schematic diagram showing an internal structure of respective image forming units 2K, 2Y, 2M, 2C. It is to be noted that FIG. 2 shows only the internal structure of the image forming unit 2K as a representative but other image forming units 2Y, 2M, 2C have substantially the same structure.

In FIG. 2, the image forming unit 2K has a structure including the photosensitive drum 6K, a charge roller 5K uniformly charging the photosensitive drum 6K, an LED head 3K serving as an exposure unit for writing electrostatic latent images by exposing the surface of the photosensitive drum 6K, a developing roller 7K developing the electrostatic latent images on the surface of the photosensitive drum 6K with a toner, a sponge roller 9K supplying the toner on the surface of the developing roller 7K and triboelectrically charging the surface to a minus polarity as rubbing the toner between this roller 9K and the developing roller 7K, a developing blade 8K forming a uniform thin layer of the toner supplied onto the surface of the developing roller 7K, a developer container 10K supplying the toner to the sponge roller 9K, and a cleaning blade 4K cleaning the toner remaining on the photosensitive drum surface.

Although the developer container 10K contains a black toner where FIG. 2 shows the internal structure of the image forming unit 2K, the developer containers of the other image forming units 2Y, 2M, 2C contain yellow toner, magenta toner, and cyan toner, respectively.

The intermediate transfer belt 12 is suspended with a drive roller 13, an idle roller 14, and a secondary transfer backup roller 235, and constitutes an image carrier for carrying images formed on the surfaces of the photosensitive drums 6K, 6Y, 6M, 6C. The intermediate transfer belt 12 rotates in a direction of arrow A in FIG. 1. The intermediate transfer belt 12 can be made of, e.g., a semiconductive plastic film molded in an endless belt shape.

Primary transfer rollers 15K, 15Y, 15M, 15C are arranged at positions facing the photosensitive drums 6K, 6Y, 6M, 6C astride the intermediate transfer belt 12. Those structures may be called as primary transfer units.

The primary transfer rollers 15K, 15Y, 15M, 15C are pushed and contact to the photosensitive drums 6K, 6Y, 6M, 6C, respectively, by elastic bodies, such as, e.g., springs in the primary transfer units, thereby forming primary transfer nipping areas.

The toner images formed on the photosensitive drums 6K, 6Y, 6M, 6C in the primary transfer units are transferred to the intermediate transfer belt 12 according to the primary transfer bias applied to the primary transfer rollers 15K, 15Y, 15M, 15C and accumulated on the belt.

The accumulated toner images reach the secondary transfer unit upon conveyance by means of the intermediate transfer belt 12. The secondary transfer backup roller 35 and the secondary transfer roller 36 are arranged astride the intermediate transfer belt 12. These structures may be called to as the secondary transfer unit.

In general, used as the secondary transfer roller are having an intermediate resistance of a volume resistivity of $10^5$ Ωcm to $10^9$ Ωcm, preferably $10^6$ Ωcm to $10^8$ Ωcm. On the other hand, the volume resistivity of the recording medium is of a variety such as $10^8$ Ωcm to $10^{15}$ Ωcm.

In a case where the toner images are secondarily transferred to the recording medium having a relatively high volume resistivity, following problems may raise.

The width of the secondary transfer roller is designed longer by around several millimeters than the width of the recording medium having the widest wide secondarily transferable. Consequently, there exist a portion sandwiching the recording medium and a portion not sandwiching the recording medium, between the intermediate transfer belt and the secondary transfer roller in the secondary transfer nipping area.

The resistance value of the portion sandwiching the recording medium in the secondary transfer nipping area (hereinafter referred to as medium inside region) is made higher for existence of the recording medium in comparison with the resistance value of the portion not having the recording medium (hereinafter referred to as medium outside region). Where a recording medium having a relatively high volume resistivity (e.g., $10^{11}$ Ωcm or more) exists, the resistances between the medium inside region and the medium outside region are made different remarkably. With such a circumstance, the secondary transfer current density flowing through the medium inside region is largely different from the secondary transfer current density flowing through the medium outside region, and in some cases, those may be different by twice or more.

The recording medium generally has various sizes even being made of the same material, and therefore, the width of the recording medium can be various. Where the recording medium having a relatively high volume resistivity is used, if the width of the recording medium is different, the total currents flowing through the entire secondary nipping area, or namely the secondary transfer current value, resultantly becomes largely different because the secondary transfer current densities are largely different between the medium inside region and the medium outside region.

To obtain good secondary transfer consequences, it is required to control the current density in the medium inside region to be a prescribed value, but if the width of the recording medium changes as described above, the secondary transfer current value as the total of the current value in the medium inside region and the current value in the medium outside region is required to be controlled to be a different current value.

Consequently, it is desirable to provide an image forming apparatus easily precisely controlling the secondary transfer current value so as to maintain the current density in the medium inside region to be a prescribe value even where the width of the recording medium changes.

The recording medium containing cassette 19 contains a recording medium bundle 40 as a bundle made of the recording media 41. The hopping roller 16 picks up a topmost-layer recording medium 41 out of the recording media bundle 40 contained in the recording medium containing cassette 19. The picked recording medium 41 is fed toward a nipping area between the registration roller 17 and the pinching roller 18.

Figure 3:
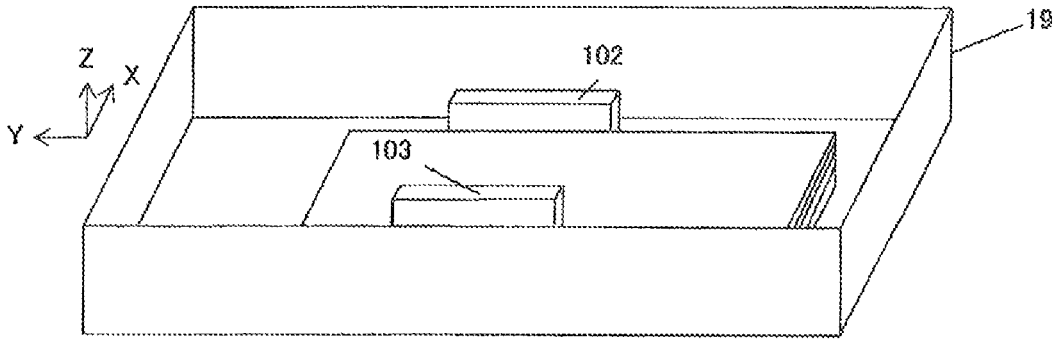
FIG. 3 is a schematic diagram showing a structure of a recording medium containing cassette according to the first embodiment of the invention.

FIG. 3 shows a schematic diagram showing a structure of the recording medium containing cassette 19. As shown in FIG. 3, the recording medium containing cassette 19 is movable in an X-direction and has medium width stoppers 102, 103 for securing the contained recording media 41. In FIG. 3, the X-direction is a width direction of the recording medium bundle 40; a Y-direction is a length direction of the recording medium bundle 40; a Z-direction is a height direction of the recording medium bundle 40.

Figure 4:
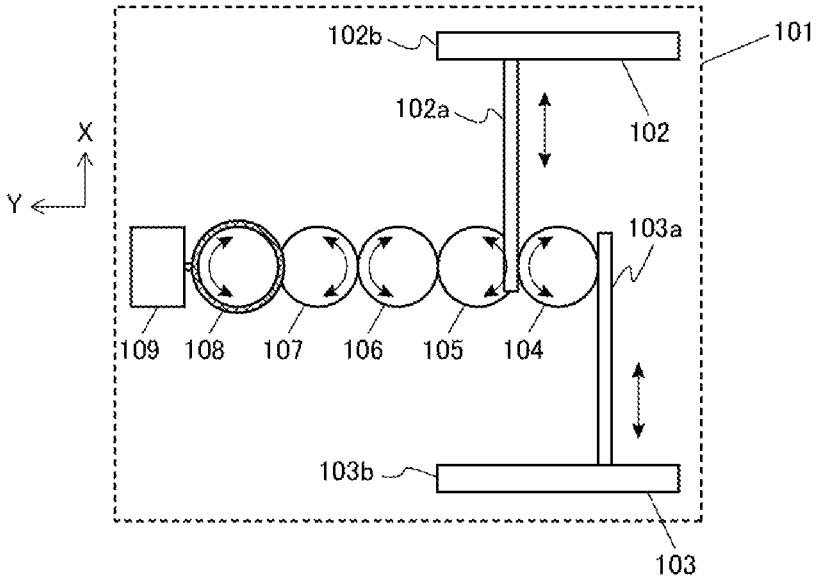
FIG. 4 is a schematic diagram showing a medium width detection mechanism of the recording medium containing cassette according to the first embodiment of the invention.

Referring to FIG. 4, a medium width detection mechanism 101 for detecting the length in the width direction, or the width of the recording medium 41 contained in the recording medium containing cassette 19 with the medium width stoppers 102, 103, is described. The medium width detection mechanism 101 is an example of a width detecting unit.

FIG. 4 is a schematic diagram showing the medium width detection mechanism 101 of the recording medium containing cassette 19. In FIG. 4, the X-direction is a width direction of the recording medium bundle 40; the Y-direction is a length direction of the recording medium bundle 40.

As shown in FIG. 4, the medium width detection mechanism 101 includes the medium width stoppers 102, 103, gears 104 to 107, a switching changeover member 108, and a switching unit 109.

In FIG. 4, the medium width stoppers 102, 103 are movable in the X-direction according to the width of the recording medium bundle 40. When the recording medium containing cassette 19 contains the recording medium bundle 40, a user moves medium width stopper plates 102*b*, 103*b* in the X-direction and make inner surfaces of the medium width stopper plates 102*b*, 103*b* contacting with side surfaces of the recording medium bundle 40. The medium width stopper plates 102*b*, 103*b* are coupled with sliding portions 102*a*, 103*a* extending in the X-direction, respectively. The sliding portions 102*a*, 103*a* slide in the X-direction according to the movement of the medium width stopper plates 102*b*, 103*b*.

The sliding portions 102*a*, 103*a* are coupled with the gear 104. The gear 104 rotates according to the movement in the X-direction of the sliding portions 102*a*, 103*a*. The gears 105 to 107 transmit rotation of the gear 104 to the switching changeover member 108.

The switching changeover member 108 receives rotation from the gear 107 and makes the switching unit 109, contacting thereto, turned on and off according to rotation of the switching changeover member 108.

Figure 5:
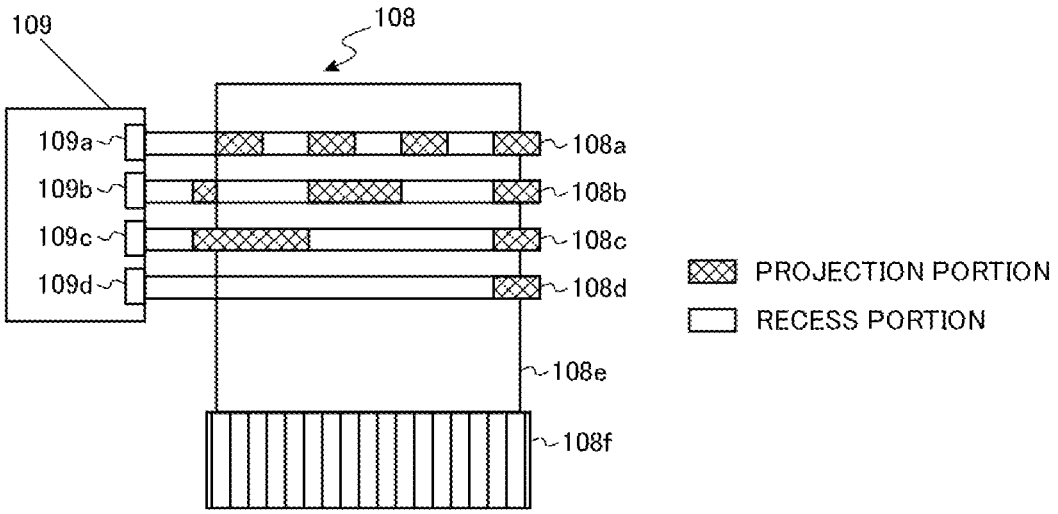
FIG. 5 is a schematic diagram showing a connection relationship between a switching changeover member and a switching unit according to the first embodiment of the invention.

FIG. 5 is a diagram showing a connection relationship between the switching changeover member 108 and the switching unit 109.

As shown in FIG. 5, the switching changeover member 108 is structured in having a body 108*e* in, e.g., a cylindrical shape, four contact rings 108*a* through 108*d* contacting the switching unit 109, and a gear portion 108*f* connected to the gear 107.

The four contact rings 108*a* through 108*d* are annular members having projection portions and recess portions (or contacting pieces) with cyclic periods of 1 to 2 to 4 to 8, respectively. The projection portions of the contact rings 108*a* through 108*d* turn on switches 109*a* through 109*d* in the switching unit 109 whereas the recess portions of the contact rings 108*a* through 108*d* turn off the switches 109*a* through 109*d* in the switching unit 109.

Figure 6:
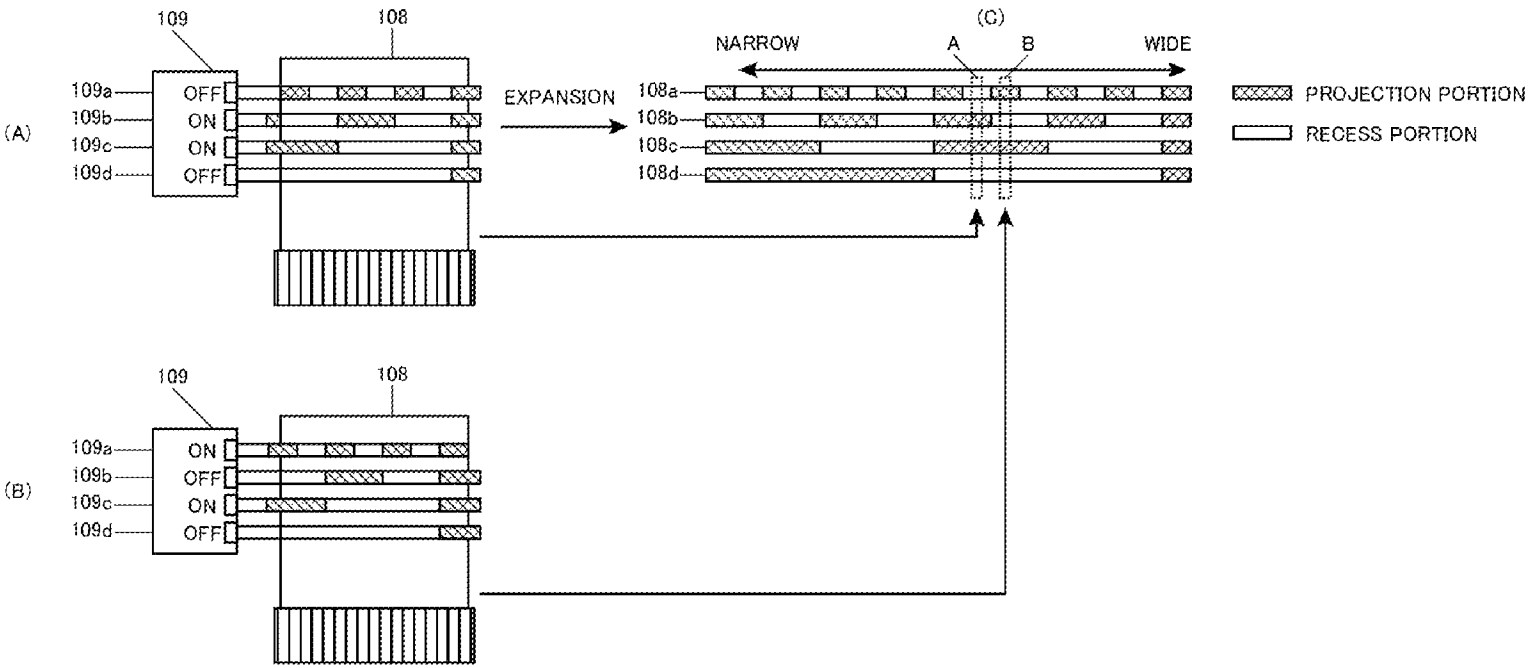
FIG. 6 is an illustration showing switching operation done with the switching changeover member according to the first embodiment of the invention.

FIG. 6 is an illustration for describing switching operation done at the switching unit 109 with the switching changeover member 108.

The rotational angle of the switching changeover member 108 is in association with an interval between the medium width stoppers 102, 103, or namely with the width of the recording medium bundle 40. The combination of on and off at the respective switches 109*a* through 109*d* therefore varies according to the width of the recording medium bundle 40.

For example, where the switching changeover member 108 and the switches 109*a* through 109*d* are made in contact with each other at a position A in FIG. 6(C), the combination of on and off of the switches 109*a* through 109*d* is (OFF, ON, ON, OFF). In a case where contacted at a position B in FIG. 6(C), the combination of on and off of the switches 109*a* through 109*d* is (ON, OFF, ON, OFF).

Thus, the combination of on and off of the switches 109*a* through 109*d* corresponds to the recording medium 41.

Figures 7, 8:
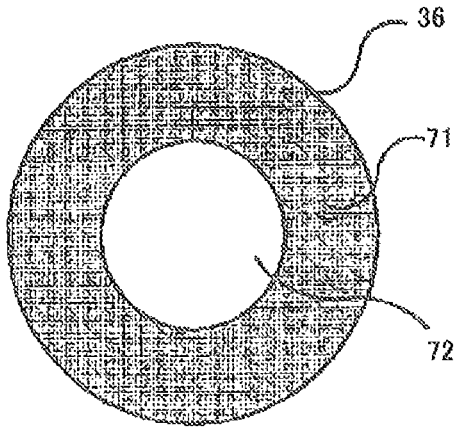
FIG. 7 is a table showing a relationship between on/off state of the switches and recording medium widths according to the first embodiment of the invention.
FIG. 8 is a schematic cross section of a secondary transfer roller according to the first embodiment of the invention.

FIG. 7 is a diagram showing a conversion table 110 showing a relationship between on and off state of the switches 109*a* through 109*d* and widths of recording medium 41. A controller 53 in the multicolor image recording apparatus 1A as described below looks up the conversion table 110 shown in FIG. 7 and can detect the width of the recording medium 41 based on signals from the switches 109*a* to 109*d*.

For example, in a case that the combination of on and off of the switches 109*a* through 109*d* is (OFF, OFF, OFF, OFF) in the conversion table 110 in FIG. 7, the width of the recording medium 41 can be judged as 210 mm to 220 mm.

Although, in this embodiment, the width of the recording medium 41 is detected based on the combination of on and off of the four switches 109*a* through 109*d*, the number of the switches is not limited to four.

In FIG. 1, the recording medium 41 picked up by the hopping roller 16 reaches the nipping area between the registration roller 17 and the pinching roller 18.

The registration sensor 21 detects an arrival of the recording medium 41 at the nipping area between the registration roller 17 and the pinching roller 18.

The registration roller 17 feeds the recording medium 41 to the secondary transfer unit at a timing in synchronicity with an arrival of the toner image primarily transferred to the intermediate transfer belt 12 at the secondary transfer nipping area between the secondary transfer backup roller 35 and the secondary transfer roller 36.

The intermediate transfer belt 12 is nipped with the secondary transfer roller 36 and the secondary transfer backup roller 35 in the secondary transfer unit, thereby forming the secondary nipping unit. The secondary transfer unit is an example of a transfer unit according to the invention.

FIG. 8 is a cross section showing a secondary transfer roller 36 according to this embodiment. As shown in FIG. 8, the secondary transfer roller 36 is structured of a metal shaft 72, and a semiconductive layer 71 covering the metal shaft 72. It is to be noted that the secondary transfer backup roller 35 is structured of a metal entirely.

The recording medium 41 fed to the secondary transfer unit is nipped at the secondary transfer nipping area as being overlapped with the toner images formed on the intermediate transfer belt 12. A secondary transfer voltage is applied to the secondary transfer roller 36, thereby transferring the toner images on the intermediate transfer belt 12 to the recording medium 41.

The recording medium 41 to which the toner images on the intermediate transfer belt 12 are transferred is further conveyed by the intermediate transfer belt 12 and the secondary transfer roller 36, and reaches a fixing device 28.

The fixing device 28 is, as shown in FIG. 1, structured of a fixing roller 25, a halogen heater 27 for heating the interior of the fixing roller 25, and a pressure roller 26.

The pressure roller 26 is pushed to the fixing roller 25 by an elastic body such as, e.g., a spring and forms a fixing nipping area.

The recording medium 41 arrived at the fixing device 28 is heated and pressurized at the fixing nipping area, and multicolor images are formed on the recording medium 41 as the toner images transferred to the recording medium 41 are melt and fixed. The recording medium formed with the multicolor images is delivered to a stacker 30 on a top of the multicolor image forming apparatus as guided by a delivery guide 51.

A temperature and humidity sensor 69 is mounted on the image forming apparatus 1, thereby detecting the temperature and humidity around the image forming apparatus 1.

A structure of a controlling system 50A in the multicolor image forming apparatus 1A according to the first embodiment is described next with reference to the drawings.

Figure 9:
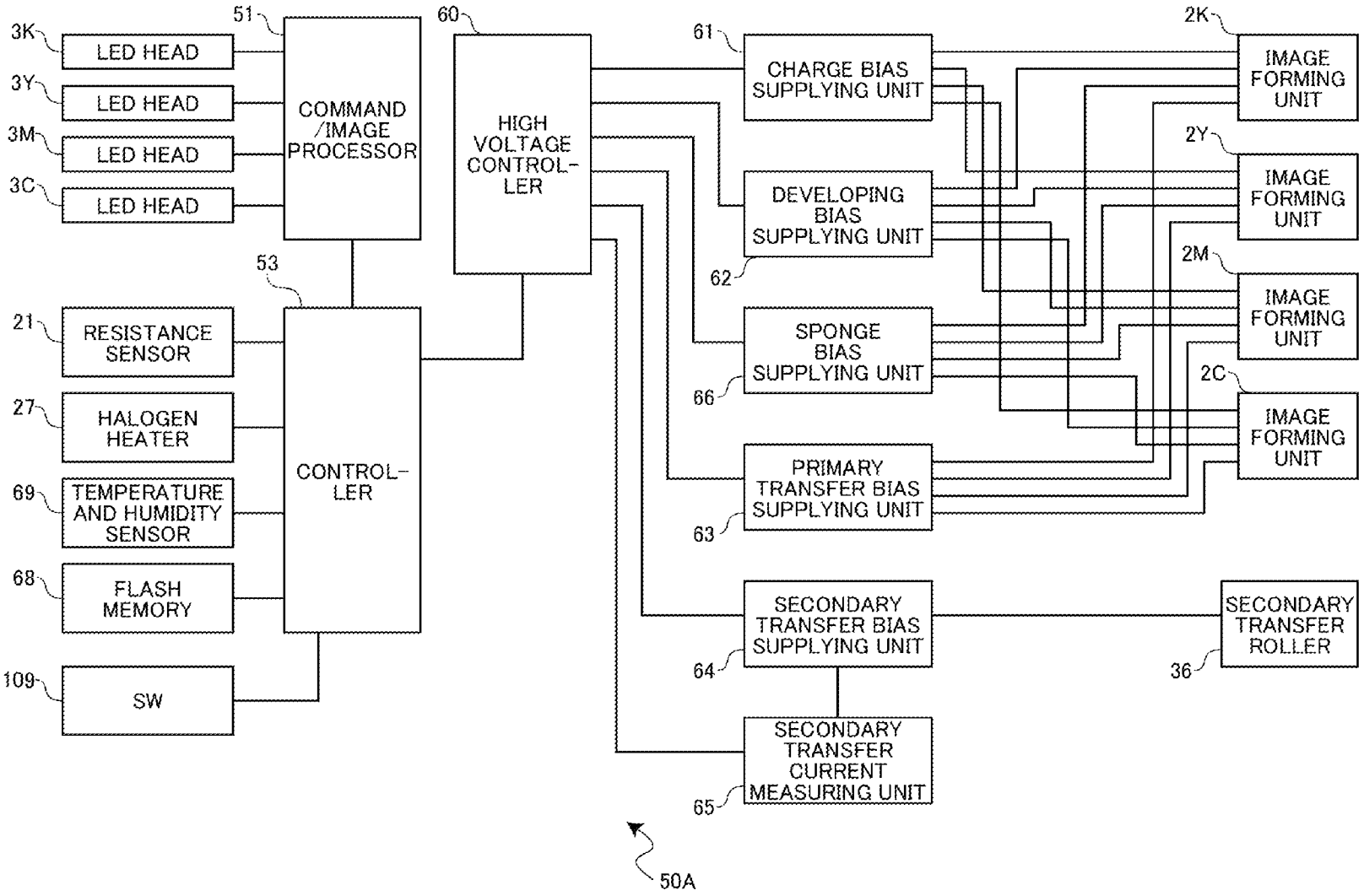
FIG. 9 is a block diagram showing a control system structure of the multicolor image forming apparatus according to the first embodiment of the invention.

FIG. 9 is a block diagram showing the structure of the controlling system 50A in the multicolor image forming apparatus 1A according to the first embodiment. In FIG. 9, some units such as, e.g., the controller 53, a high voltage controller 60, and command/image processor 51 are realized by CPU's execution of the processing program stored in a memory unit.

The command/image processor 51 is a processing unit or device for processing commands and image data from a host side and controls the whole multicolor image forming apparatus 1. The command/image processor 51 interprets the image data, develops the image data to bitmap data, and provides the bitmap data to the LED heads 3K, 3Y, 3M, 3C.

The controller 53 monitors outputs from the registration sensor 21 according to the instructions from the command/image processor 51 and provides control for the halogen heater 27 in the fixing device 28 and instructions for high voltage outputs for the high voltage controller 60.

The controller 53 is coupled to a flash memory 68, reads out control programs stored in the flash memory 68, and executes the control programs.

The controller 53 is further coupled to the temperature and humidity sensor 69 and detects the temperature and humidity around the image forming apparatus 1. The controller 53 is yet further coupled to the switch unit 109 and detects the width of the recording medium bundle 40 contained in the recording medium containing cassette 19 based on the signals of on and off sent from the switch unit 109 in referring to the conversion table 110 shown in FIG. 7.

The high voltage controller 60, upon reception of instructions of respective high voltage outputs from the controller 53, controls a charge bias supplying unit 61, a developing bias supplying unit 62, a sponge bias supplying unit 66, a primary transfer bias supplying unit 63, and a secondary transfer bias supplying unit 64.

The charge bias supplying unit 61 herein supplies charge bias voltages to the charge rollers 5K, 5Y, 5M, 5C. The developing bias supplying unit 62 supplies developing bias voltages to the developing rollers 7K, 7Y, 7M, 7C. The sponge bias supplying unit 66 supplies sponge bias voltages to the sponge rollers 9K, 9Y, 9M, 9C.

The primary transfer bias supplying unit 63 supplies primary transfer bias voltages to the primary transfer rollers 15K, 15Y, 15M, 15C. The secondary transfer bias supplying unit 64 supplies a secondary transfer bias voltage to the secondary transfer roller 36.

The secondary transfer bias supplying unit 64 is controlled with constant voltages by the high voltage controller 60 and outputs a certain constant voltage at an output terminal of the secondary transfer bias supplying unit 64. The secondary transfer bias supplying unit 64 is an example of a voltage supplying unit.

The high voltage controller 60 is connected to a secondary transfer current measuring unit 65 for measuring a secondary transfer current flowing through the secondary transfer roller 36. The secondary transfer current measuring unit 65 is an example of the transfer current measuring unit.

Figure 10:
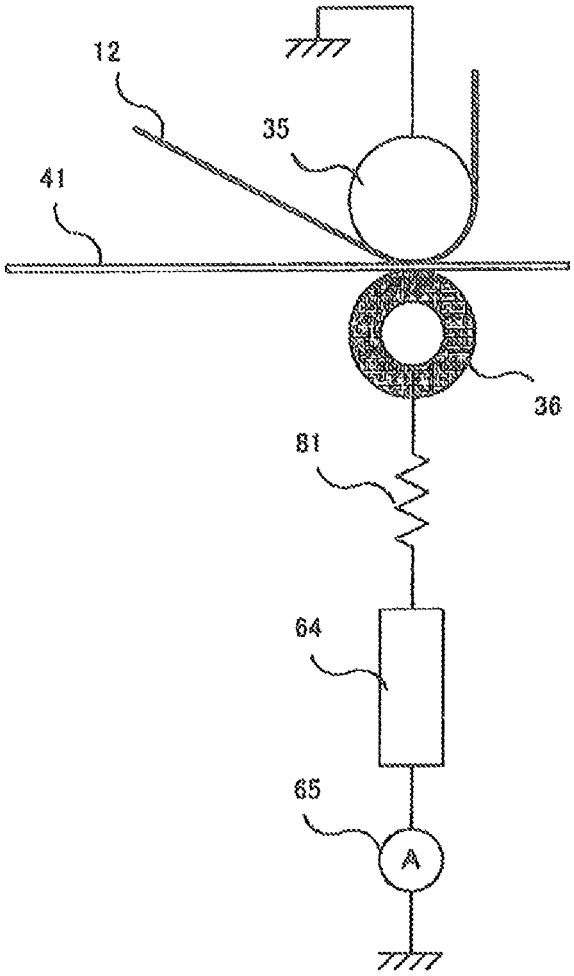
FIG. 10 is a schematic diagram showing a connection structure of a secondary transfer bias supplying unit, a secondary transfer current detecting unit, and a secondary transfer roller according to the first embodiment of the invention.

FIG. 10 is a schematic diagram showing a connection relationship among the secondary transfer bias supplying unit 64, the secondary transfer current measuring unit 65, and the secondary transfer roller 36.

The secondary transfer bias supplying unit 64 is coupled to the ground level via the secondary transfer current measuring unit 65 and is coupled to the secondary transfer roller 36 via a fixed resistor 81. The secondary transfer backup roller 35 is coupled to the ground level.

Accordingly, the secondary transfer current measuring unit 65 is able to measure the secondary transfer current value flowing the secondary transfer unit.

The fixed resistor 81 as a resistor can serve for reducing transfer irregularity caused by irregularity in a volume resistivity of the secondary transfer roller 36 in a circumferential direction. That is, when a low volume resistivity portion of the secondary transfer roller 36 is in contact with the intermediate transfer belt 12, the secondary transfer current value increases, but current increment is limited from the increased voltage drop at the fixed resistor 81 at the same time.

To the contrary, when a high volume resistivity portion of the secondary transfer roller 36 is in contact with the intermediate transfer belt 12, the secondary transfer current value decreases, but current decrement is limited from the reduced voltage drop at the fixed resistor 81 at the same time. As a result, deviations of the secondary transfer current value due to irregularity in a resistance of the secondary transfer roller 36 in the circumferential direction, can be reduced.

In operation, the multicolor image forming apparatus 1A begins image forming operation upon receiving printing image data.

In FIG. 9, the controller 53 controls the halogen heater 27 to apply heat to the fixing device 28, thereby controlling the toner images to be in a temperature range fixable to the recording medium 41.

Where the fixing device 28 is warmed up, the controller 53 begins driving of the drive roller 13 and the respective image forming units 2K, 2Y, 2M, 2C. The controller 53 at the same time provides an instruction to the high voltage controller 60 to turn on the charge bias supplying unit 61, the developing bias supplying unit 62, and the sponge bias supplying unit 66, thereby supplying a prescribed high voltage bias to the image forming units 2K, 2Y, 2M, 2C.

Forming operation of the toner images on the photosensitive body 6 is described herein in exemplifying the image forming unit 2K.

A charge bias voltage of −1000 V is supplied from the charge bias supplying unit 61 to the charge roller 5K, thereby charging the surface of the photosensitive body 6 at the voltage of −600 V. A developing bias voltage of −200 V is supplied from the developing bias supplying unit 62 to the developing roller 7K. A sponge bias voltage of −250 V is supplied from the sponge bias supplying unit 66 to the sponge roller 9K.

The toner supplied from the developer container 10K is triboelectrically charged to a minus polarity upon strongly being rubbed with the sponge roller 9K and the developing roller 7K. The toner triboelectrically charged to the minus polarity is made attaching to the developing roller 7K according to the potential difference between the sponge bias voltage and the developing bias voltage. The toner attached to the developing roller 7K is made even to have a uniform thickness with the developing blade 8K, thereby forming a toner layer on the developing roller 7K. The toner layer formed on the developing roller 7K is carried to the nipping area of the photosensitive body 6K according to the rotation of the developing roller 7K.

The command/image processor 51 makes exposures of the surface of the photosensitive body 6K by driving the LED head 3K. The exposed portions on the surface of the photosensitive body 6K are discharged to be at −50 V, thereby forming electrostatic latent images. The electrostatic latent images are conveyed to the nipping area between the developing roller 7K and the photosensitive body 6K according to the rotation of the photosensitive body 6K. Because the developing bias voltage of −200 V is applied to the developing roller 7K, the toner charged to the minus polarity is attached only to the electrostatic latent image portions on the photosensitive body 6K from the potential difference, thereby being developed as toner images.

In the image forming units 2Y, 2M, 2C, toner images are developed on the photosensitive bodies 6Y, 6M, 6C, respectively, in substantially the same way as the image forming unit 2K.

When the toner images are formed on the photosensitive bodies 6K, 6Y, 6M, 6C, the high voltage controller 60 turns on the primary transfer bias supplying unit 63 before the toner images on the photosensitive bodies 6K, 6Y, 6M, 6C reach contact portions between the intermediate belt 12 and the photosensitive bodies 6K, 6Y, 6M, 6C, or namely the primary transfer nipping area, thereby supplying the primary transfer bias voltage to the transfer rollers 15K, 15Y, 15M, 15C. With this operation, the toner images formed on the photosensitive bodies 6K, 6Y, 6M, 6C are transferred to and overlapped on the intermediate transfer belt 12.

When the primary transfer of the toner images to the intermediate belt 12 begins, the controller 53 takes out the recording medium 41 from the recording medium containing cassette 19 upon driving the hopping roller 16 after a prescribed timing. The recording medium 41 taken out is fed to the nipping area between the registration roller 17 and the pinching roller 18.

The registration roller 17 drives to feed the recording medium 41 to the secondary transfer nipping unit in synchrony with a timing that the toner images on the intermediate transfer belt 12 reach the secondary transfer nipping area. The recording medium 41 is nipped and conveyed to the secondary transfer nipping area as overlapped with the toner images on the intermediate transfer belt 12.

The controller 53 turns on the secondary transfer bias supplying unit 64 in synchrony with a timing that the recording medium 41 is fed to the secondary transfer nipping area, thereby supplying the secondary transfer bias to the secondary transfer roller 36. Consequently the toner images on the intermediate transfer belt 12 are transferred to the recording medium 41.

The recording medium 41 is guided to the fixing device 28 upon passing through the nipping area between the secondary transfer roller and the secondary transfer backup roller. When the recording medium 41 reaches the fixing device 28, the toner images are fixed to the recording medium 41 through sandwiched conveyance by means of a heating roller, or the fixing roller 25, already heated at a fixable temperature and of the pressure roller 26. Upon completion of fixing, the recording medium 41 is guide with the delivery guide 51 and delivered to the stacker 30 as the completion of printing operation.

Thus, multicolor images are recorded on the recording medium 41 taken out of the recording medium containing cassette 19.

Figure 11:
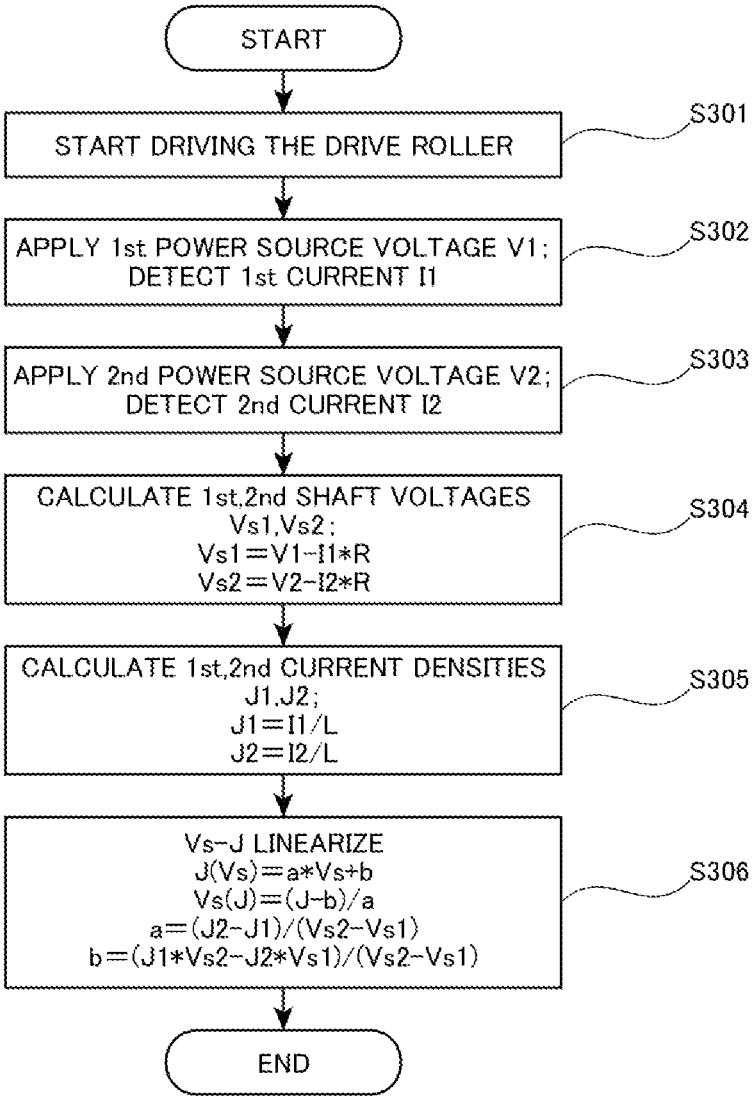
FIG. 11 is a flowchart showing a voltage-current character detecting operation processing at the secondary transfer unit according to the first embodiment of the invention.

Next, referring to FIG. 11, detection operation of voltage-current character at the secondary transfer unit according to the first embodiment is described. FIG. 11 is a flowchart showing processing of detection operation of voltage-current character at the secondary transfer unit according to the first embodiment.

The detection operation of voltage-current character in the first embodiment is performed prior to printing operation, e.g., at a time of power on, or at a time of reception of printing jobs. In other words, the detection of voltage-current character is executed while no recording medium 41 exists in the secondary transfer nipping area.

When the detection operation of voltage-current character begins, in FIG. 11, the controller 53 begins driving of the drive roller 13 (S301).

The high voltage controller 60 subsequently controls the secondary transfer bias supplying unit 64 to apply a prescribed first voltage V1 [V] to the secondary transfer unit, and the secondary transfer current measuring unit 65 detects a secondary transfer current value I1 [μA] (S302).

Similarly, the high voltage controller 60 subsequently controls the secondary transfer bias supplying unit 64 to apply a prescribed second voltage V2 [V] to the secondary transfer unit, and the secondary transfer current measuring unit 65 detects a secondary transfer current value I2 [μA] (S303).

The measurement of the secondary transfer current values I1, I2 done by the secondary transfer current measuring unit 65 is executed in a state that no recording medium 41 exists in the secondary transfer nipping area. The secondary transfer current measuring unit 65 performs, at least one time, measurement of the secondary transfer current values I1, I2 in the state that no recording medium 41 exists in the secondary transfer nipping area. For example, after the power is turned on, the measurements of the secondary transfer current values I1, I2 may be performed at least one time prior to printing operation.

The controller 53 calculates, based on the Ohm's law, intra-shaft voltages Vs1, Vs2 [V] provided between the metal shaft 72 of the secondary transfer roller 36 and the backup roller 35 at a time of application of the first voltage V1 [V] and the second voltage V2 [V] (S304).

$$Vs1=V1-I1*R \quad \text{Formula (1)}$$

$$Vs2=V2-I2*R \quad \text{Formula (2)}$$

It is provided that R [MΩ] is a resistance of the fixed resistor 81. Then, current densities J1, J2 [μA/mm] are calculated based on Formulas (3), (4) below where the intra-shaft voltages are Vs1, Vs2 [V] (S305). It is to be noted that the current density indicate a current value per a unit length of the secondary transfer roller 36. The secondary transfer roller 36 has a length of L [mm].

$$J1=I1/L \quad \text{Formula (3)}$$

$$J2=I2/L \quad \text{Formula (4)}$$

The controller 53 subsequently uses a liner approximation equation representing the correlation between the intra-shaft voltage Vs [V] and the current density J [μA/mm] (S306).

$$J=a*Vs+b \quad \text{Formula (5)}$$

$$\text{wherein } a=(J2-J1)/(Vs2-Vs1) \quad \text{Formula (6)}$$

$$\text{and wherein } b=(J1*Vs2-J2*Vs1)/(Vs2-Vs1) \quad \text{Formula (7)}$$

In accordance with above Formulas, the relation between Vs [V] and J [μA/mm] where no recording medium 41 exists in the secondary transfer nipping area can be sought.

The calculation from Formulas (1) to (6) done at the controller 53 is made at least one time prior to the printing operation after power is turned on.

FIG. 12 shows a medium current table 120 for medium currents; FIG. 13 shows a medium voltage table 121 for medium voltages.

The medium current table 120 and the medium voltage table 121, serving as electrical character information of the recording medium, are stored in, e.g., a flash memory 68 as a memory unit. The controller 53, using the medium current table 120 and the medium voltage table 121 stored in the flash memory 68, decides a secondary transfer bias value at a time when transferring the toner images onto the recording medium 41.

The medium current table 120 and the medium voltage table 121, as shown in FIG. 12 and FIG. 13, have a structure having data of medium current values and medium voltage values to be looked up, respectively, according to detected values of temperature (degrees Celsius) and humidity (%) from the temperature and humidity sensor 69.

The medium current table 120 and the medium voltage table 121 are sought, when a good secondary transfer consequence is obtained, by actual measurements of current densities flowing through the recording medium portion and of voltages sustained by the recording medium. The unit of the medium current table 120 in FIG. 12 is [μA/mm], and the unit of the medium voltage table 121 in FIG. 13 is [kV].

The medium current table 120 and the medium voltage table 121 shown in FIG. 12, FIG. 13 are examples, and other tables may be set for respective types of recording medium 41 or for respective printing speeds. The classification of temperature and humidity in FIG. 12 and FIG. 13 is not limited to this, and can be made in a more or less classified manner.

Figure 14:
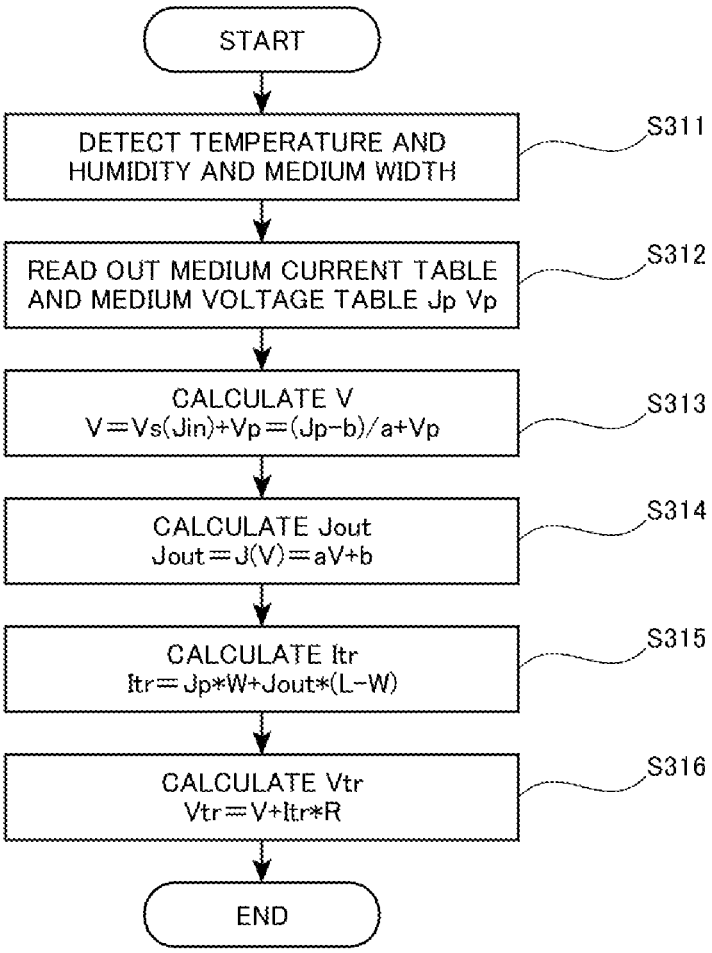
FIG. 14 is a flowchart showing a calculation method for secondary transfer bias value according to the first embodiment of the invention.

Referring to the drawings, a calculation method of secondary transfer bias value according to the first embodiment is described in detail. FIG. 14 is a flowchart showing a calculating method for secondary transfer bias value according to the first embodiment.

The controller 53 first obtains surrounding temperature and surrounding humidity from the temperature and humidity sensor 69. The controller 53 obtains a width W in a widthwise direction of the recording medium 41 from the medium width detection mechanism 101.

The width W in the widthwise direction of the recording medium 41 is detected by the medium width detection mechanism 101 described above. The width W in the widthwise direction of the recording medium 41 is set from a center value in the detected width range (S311).

For example, where the medium width detection mechanism 101 looks up the table shown in FIG. 7 on the basis of on and off signals sent from the switches 109*a* to 109*d*, the mechanism 101 detects the width of the recording medium 41 as "210 mm through 220 mm." In this situation, the controller 53 sets the width of the recording medium 41 in the widthwise direction to be 215 mm, the center value of 210 mm through 220 mm.

In a case where the switches are provided at the switching unit 109 in a larger number to detect the width of the recording medium more precisely, the controller 53 may use not the center value but the value obtained at the medium width detection mechanism 101 as it is.

Subsequently, the controller 53 looks up the medium current table 120 and the medium voltage table 121 stored in the flash memory 68 and decides, as selected values, the medium current value Jp and the medium voltage value Vp [V] based on the detected results of the temperature and humidity from the temperature and humidity sensor 69.

The controller 53 then calculates the voltage value V [V] applied between the metal shaft 72 of the secondary transfer roller 36 and the secondary transfer backup roller 35 realizing the medium current value Jp and the medium voltage value Vp [V] (S313).

Figure 15:
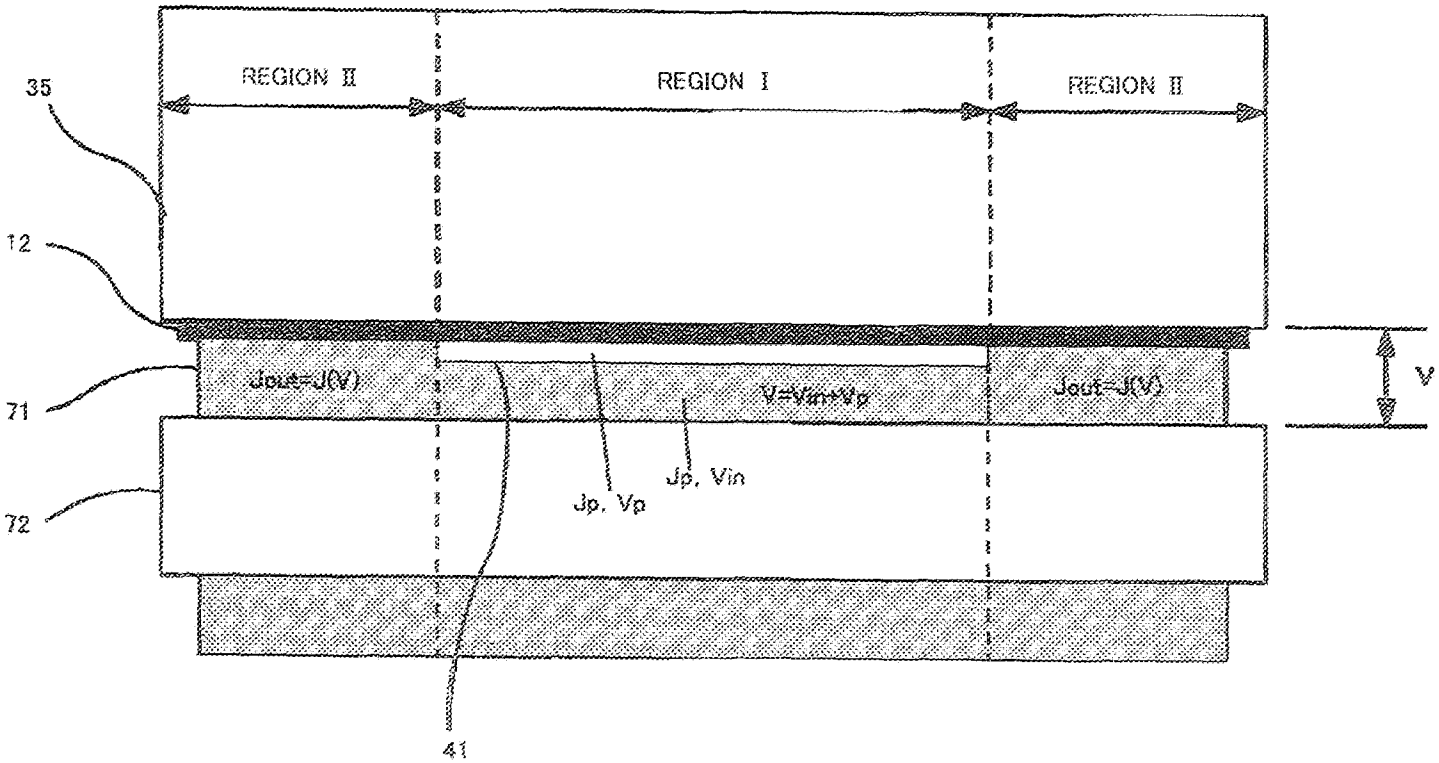
FIG. 15 is a diagram showing a profile of current and voltage in the secondary transfer area according to the first embodiment of the invention.

FIG. 15 is a diagram showing a profile of current and voltage applied in the area of the secondary transfer unit according to the first embodiment. FIG. 15, a region I is a region inside medium at which the recording medium exists 41, and a region II is a region outside medium at which no recording medium 41 exists.

The voltage value V [V] sought by the controller 53 at S313 is a voltage applied to the medium region (region I) in FIG. 15. In other words, the voltage value V is a summation of the medium voltage value Vp [V] and Vin [V] applied to the other region (region II) made of the secondary transfer roller 36 and the intermediate transfer belt 12.

Because the flowing current density is Jp [μA/mm] at the region made of the secondary transfer roller 36 and the intermediate transfer belt 12, the voltage value Vin is sought based on Formula (8) as follows:

$$Vin=(Jp-b)/a \quad \text{Formula (8)}$$

Accordingly, the voltage value V [V] is sought based on Formula (9) as follows:

$$V=Vin+Vp=(Jp-b)/a+Vp \quad \text{Formula (9)}$$

Subsequently, the controller 53 seeks the current density Jout [μA/mm] flowing through the region (region II) at which no recording medium 41 exists.

The voltage applied to the region II is equal to the voltage V of the region I because the secondary transfer backup roller 35 and the metal shaft 72 of the secondary transfer roller 36 are commonly made of metal and are forming an equipotential surface. The current density Jout [μA/mm] is sought in using Formula (10) as follows (S314):

$$Jout=a*V+b \quad \text{Formula (10)}$$

Subsequently, the controller 53 seeks the current value Itr [μA] flowing through the entire secondary transfer roller 36. Where the length of secondary transfer roller is set to L [mm] and where the width of the recording medium is W, the width of the region (region II) at which no recording medium 41 exists is L−W [mm]. Accordingly, the current value Itr [μA] is calculated as follows (S315):

$$Itr=Jp*W+Jout*(L-W) \quad \text{Formula (11)}$$

As described above, the controller 53 calculates the voltage value Vtr [V] to be outputted from the secondary transfer bias supplying unit 64 as follows (S316):

$$Vtr=V+Itr*R \quad \text{Formula (12)}$$

Where the voltage value Vtr [V] thus sought is outputted from the secondary transfer bias supplying unit 64, good secondary transfer results are obtainable because the current density Jp [μA/mm] can realized at the medium region with respect to the recording medium 41 having the width W [mm].

Any one of the medium current table 120 and the medium voltage table 121 is replaceable with a table of medium resistance value Rp=Jp/Vp. If any two tables of the medium current value Jp, the medium voltage value Vp, and the medium resistance value Rp are prepared, the medium current value Jp and the medium voltage value Vp can be sought, so that the operation of the first embodiment can be realized.

As described above, according to the first embodiment, the secondary transfer can be performed excellently even where recording media have different widths, because the voltage and current character detection operation is conducted in a state that no recording medium 41 exists in the secondary transfer unit and because the medium width detection mechanism 101 for the recording medium 41 is provided with the medium current table 120 for excellent secondary transfer and with the medium voltage table 121 for voltages sustained by the recording medium.

Second Embodiment

An image forming apparatus according to the second embodiment of the invention is described in detail with reference to the drawings.

With the first embodiment, the secondary transfer can be performed excellently even where recording media have different widths, because the voltage and current character detection operation is conducted in a state that no recording medium 41 exists in the secondary transfer unit and because the medium width detection mechanism 101 for the recording medium 41 is provided with the medium current table 120 for excellent secondary transfer and with the medium voltage table 121 for voltages sustained by the recording medium.

With the structure according to the first embodiment, however, the apparatus may not correspond in a case of, e.g., a recording medium not in a rectangular shape, or namely, a recording medium changing its width during the secondary transfer.

In the second embodiment, it is described that an image forming apparatus performs excellent secondary transfer even for a recording medium changing its width during the secondary transfer.

Figure 16:
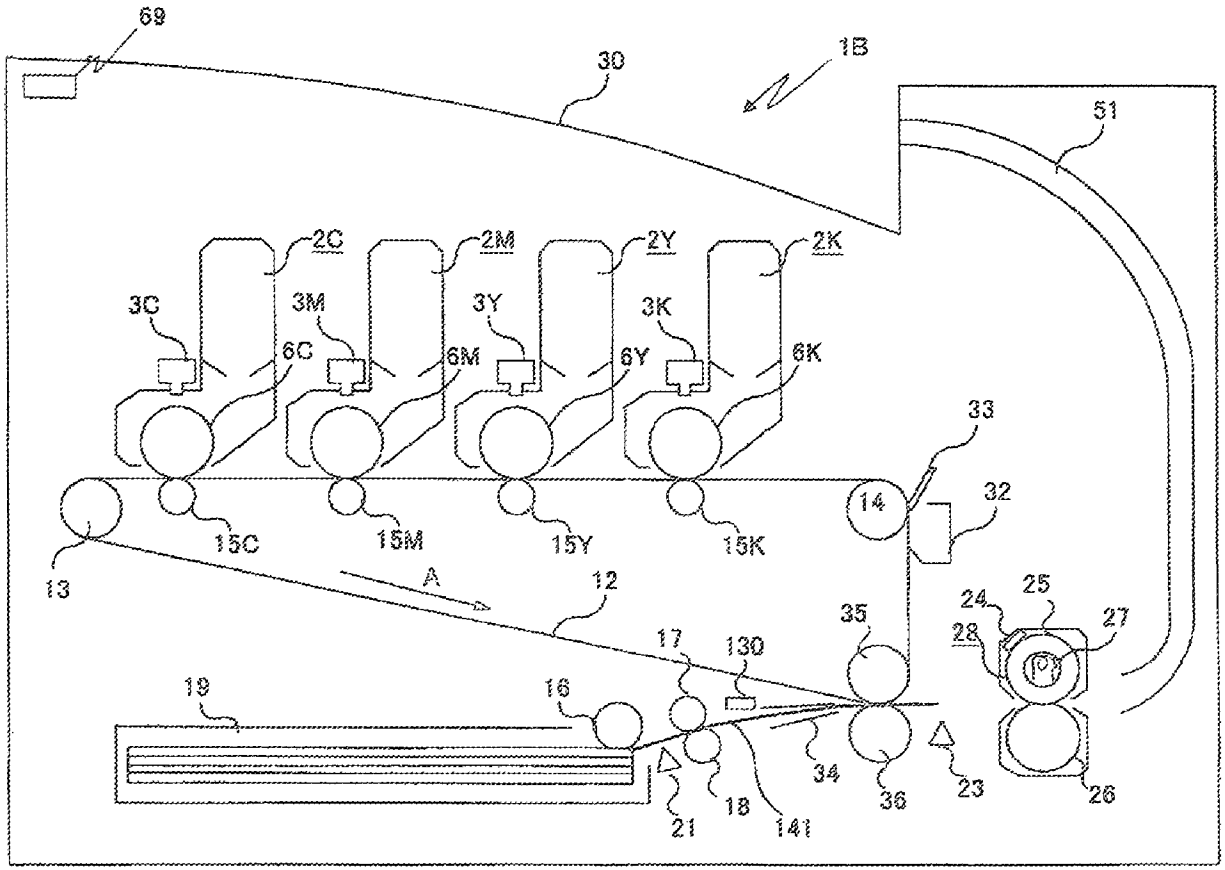
FIG. 16 is a schematic diagram showing an internal structure of a multicolor image recording apparatus according to a second embodiment of the invention.

FIG. 16 is an internal diagram showing an internal structure of a multicolor image forming apparatus 1B according to the second embodiment.

In FIG. 16, the multicolor image forming apparatus 1B according to the second embodiment includes the four image forming units 2K, 2Y, 2M, 2C, the intermediate transfer belt 12, the drive roller 13, the idle roller 14, the secondary transfer backup roller 35, the primary transfer rollers 15K, 15Y, 15M, 15C, the secondary transfer roller 36, the cleaning blade 33, the cleaner container 32, the recording medium containing cassette 19, the hopping roller 16, the registration sensor 21, the registration roller 17, the pinching roller 18, the guide member 34, the fixing device 28, the delivery guide member 51, the temperature and humidity sensor 69, and a line image sensor 130.

The multicolor image forming apparatus 1B according to the second embodiment is different from the apparatus according to the first embodiment in having the line image sensor 130 as a width detector.

It is to be noted that the same or corresponding structural elements to those in the multicolor image forming apparatus 1A according to the first embodiment are assigned with the same reference numbers.

The line image sensor 130 is disposed between the registration roller 17 and the secondary transfer backup roller 35, and continuously detects the width of the recording medium 41 fed out of the medium containing cassette 19.

Next, the structure of the control system 50B in the multicolor image forming apparatus 1B according to the second embodiment is described with reference to the drawings.

Figure 17:
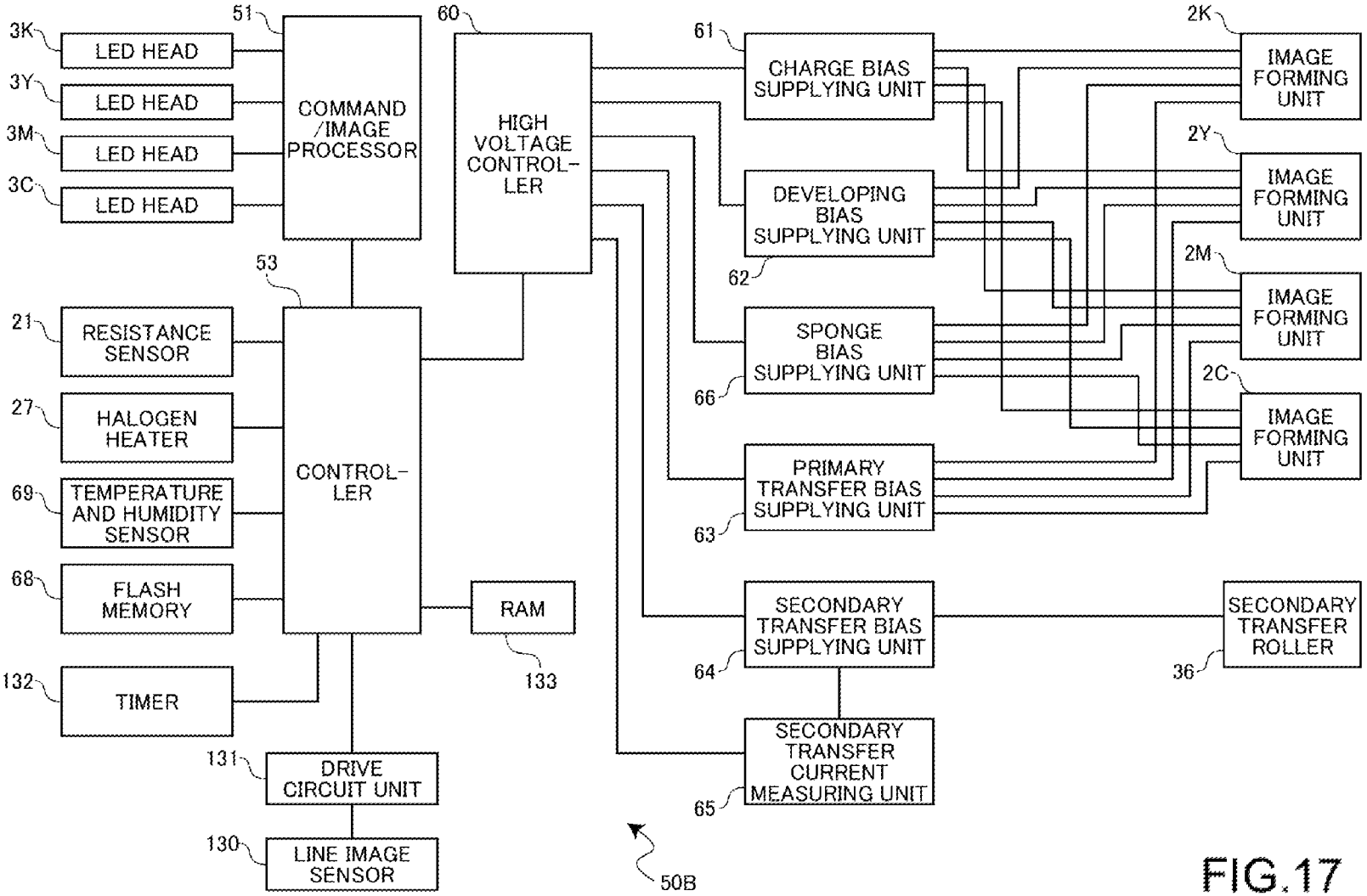
FIG. 17 is a block diagram showing a control system structure of the multicolor image forming apparatus according to the second embodiment of the invention.

FIG. 17 is a block diagram showing a structure of the control system 50B in the multicolor image forming apparatus 1B according to the second embodiment.

In FIG. 17, the control system 50B in the multicolor image forming apparatus 1B has a structure of the controller 53 having connections to a drive circuit unit 131 coupled with the line image sensor 130, to a timer 132, and to a RAM 133, in addition to the structure of control system 50A shown in FIG. 9.

It is to be noted that the controller 53 in the second embodiment is not coupled to the switching unit 109 according to the first embodiment.

The controller 53 obtains a sensor signal detecting a width of the recording medium 41 from the line image sensor 130 via the drive circuit unit 131. The controller 53 is connected to the timer 132 for measuring time, and is connected to the RAM 133 storing data temporarily.

It is to be noted that the same or corresponding structural elements to those in the block diagram of the control system 50A according to the first embodiment shown in FIG. 9 are assigned with the same reference numbers.

The operation of the multicolor image forming apparatus 1B according to the second embodiment is described with reference to the drawings.

A detailed description for operation of image forming processing in the multicolor image recording apparatus 1B is omitted since it is described in the first embodiment. Hereinafter, described in detail with reference to the drawings are continuous detection operation of recording medium width with the line image sensor 130 according to the second embodiment and secondary transfer voltage control operation in accompany with this detection operation.

When a primary transfer of the toner images onto the intermediate transfer belt 12 is started, the controller 53, after a prescribed timing, drives the hopping roller 16 to take out the recording medium 141 from the recording medium containing cassette 19, thereby feeding the recording medium 141 to a nipping area between the registration roller 17 and the pinching roller 18.

The registration roller 17 is driven to convey the recording medium 141 to a secondary transfer nipping area in synchrony with the timing that the toner images on the intermediate transfer belt 12 reaches the secondary transfer nipping area.

In accordance with conveyance of the recording medium 141 to the registration roller 17, the recording medium 141 reaches the line image sensor 130.

The line image sensor 130 is driven from the drive circuit unit 131, continuously detects cross-sectional or scanning line images of the recording medium 141 in the widthwise direction to provide data as video data to the controller 53.

The controller 53 analyzes the video data obtained from the line image sensor 130 and detects continuously the scanning line images of the recording medium 141 in the widthwise direction.

Figure 18:
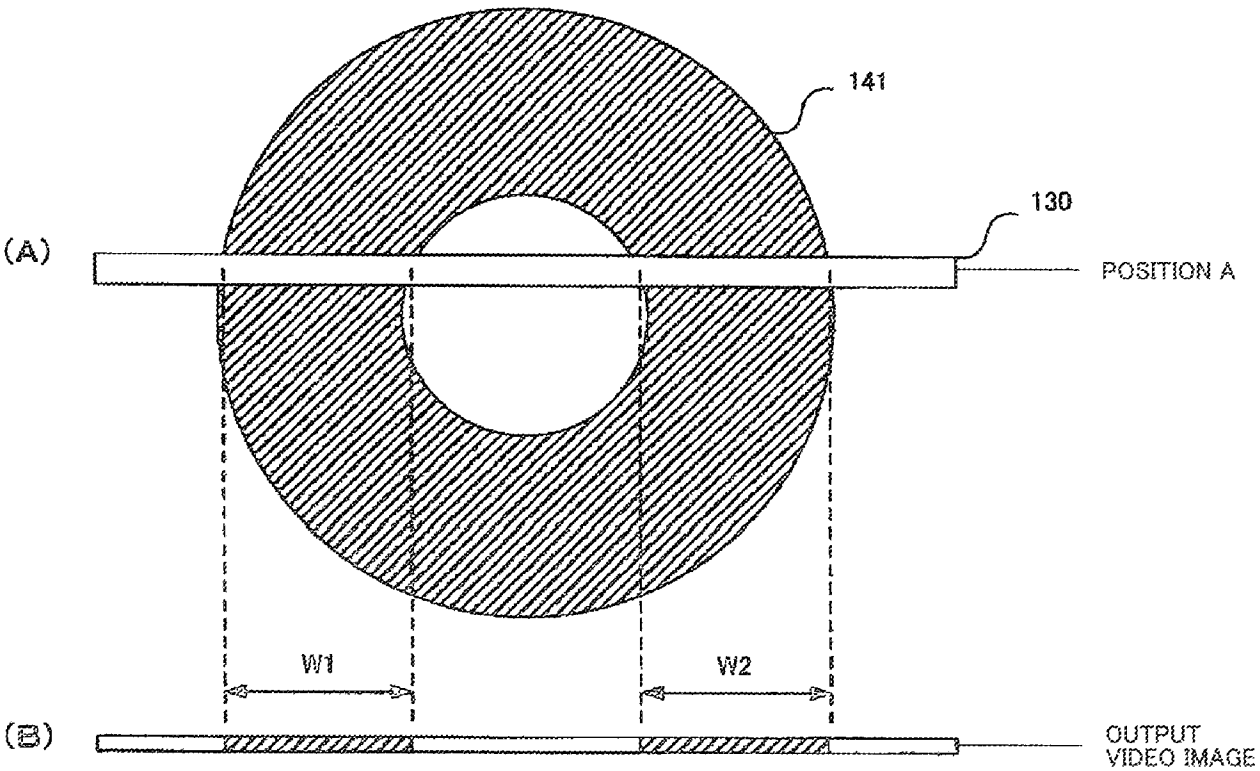
FIG. 18 is an illustration showing a shape detection processing for recording medium done with a line image sensor according to the second embodiment of the invention.

FIG. 18 is a diagram showing a shape detection processing for recording medium 141 done by the line image sensor 130 according to the second embodiment.

FIG. 18(A) is a diagram showing a positional relationship between the line image sensor 130 and the recording medium 141 passing through the line image sensor 130. FIG. 18(*b*) is a diagram showing an output video image of the recording medium 141 picked up by the line image sensor 130 positioned as shown in FIG. 18(A).

As shown in FIG. 18(A), for example, the recording medium 141 is in a donut shape. When the recording medium 141 is passing by the line image sensor 130, the line image sensor 130 provides output video images to the controller 53 upon continuously picking up the scanning line images of the recording medium 141 in the widthwise direction as the video data.

For example, in a case as shown in FIG. 18(A), the line image sensor 130 outputs output video images having medium regions W1, W2 of the recording medium 141 as shown in FIG. 18(B).

The controller 53 detects the total value W (=W1+W2) of the medium regions of the recording medium 141 when obtaining the output video images from the line image sensor 130.

Figure 19:
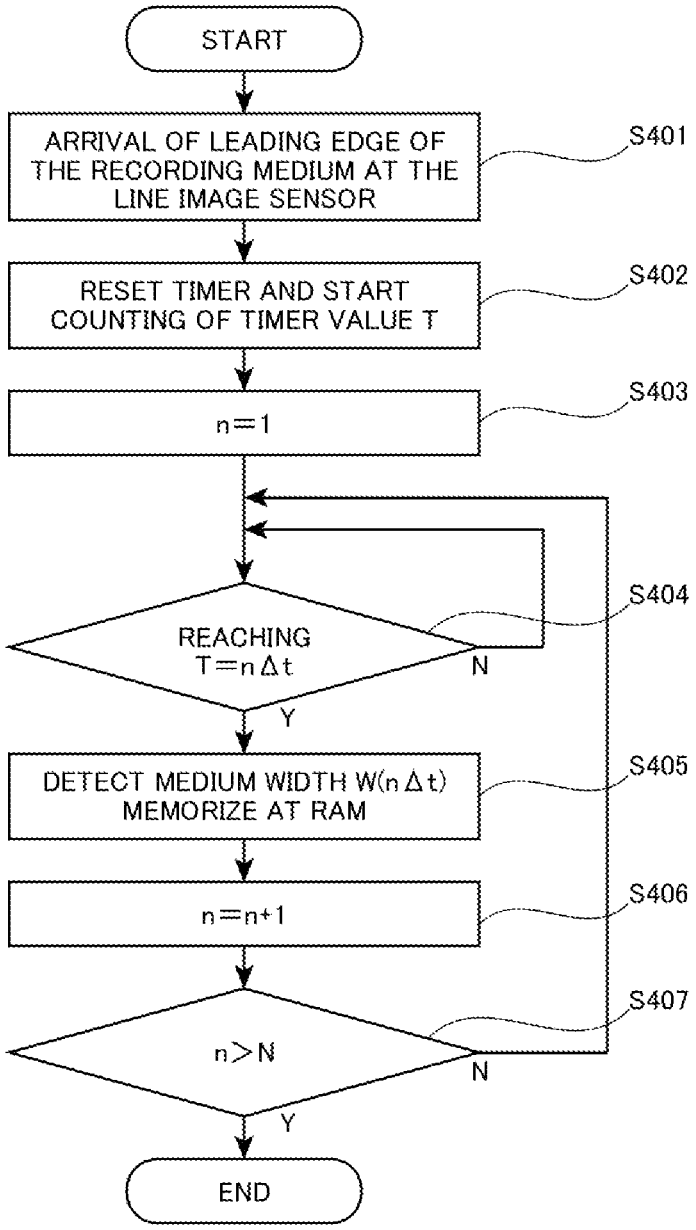
FIG. 19 is a flowchart showing a successive width detection processing for recording medium based on output video images from the line image sensor according to the second embodiment of the invention.

FIG. 19 is a flowchart showing a continuous detection processing done at the controller 53 according to the second embodiment for detecting width of the recording medium 141 based on the output video image from the line image sensor 130.

When a leading edge of the recording medium reaches the line image sensor 130 (S401), the controller 53 resets the timer 132. The controller 53 begins counting of the timer value T at the timer 132 (S402).

The controller 53 seeks the medium region width W of the recording medium 141 at each of, e.g., Δt [s] based on the output video images from the line image sensor 130 and seeks the medium region width W of N time in total (S403 to S407).

In other words, the controller 53 lets the counter value n to be n=1 (S403), seeks the medium region width W of the recording medium 141 at that time when passing the prescribed time interval (Δt) based on the timer value from the timer 132 (S404), and stores the medium region width W in the RAM 133 (S405). The symbol W(nΔt) indicates the medium region width detected at a time (n*Δt).

Then, the controller 53 increments the counter value n by one (S406), and makes the processing return to S404. This is repeated until the counter value n shows n>N (S407).

According to the processing described above, the controller 53 can detects the medium region width value W at N times with the interval of Δt [s] for the recording medium 141 passing through the line image sensor 130.

The controller 53 presumably detects the medium region width value W at N times. If the length in the lengthwise or longitudinal direction of the recording medium is set as S [mm], the number of the detection times is preferably S/10 or more. The detection times N is more preferably a minimum integer equal to or more than S/10. Accordingly, if the conveyance speed of the recording medium 141 is set as u [mm/s], it is desirable to set Δt=(S/N)/u [s]. Thus, the medium region width W of the recording medium 141 can be measured with the pitch of S/N [mm] over the entire regions in the lengthwise direction.

Figure 20:
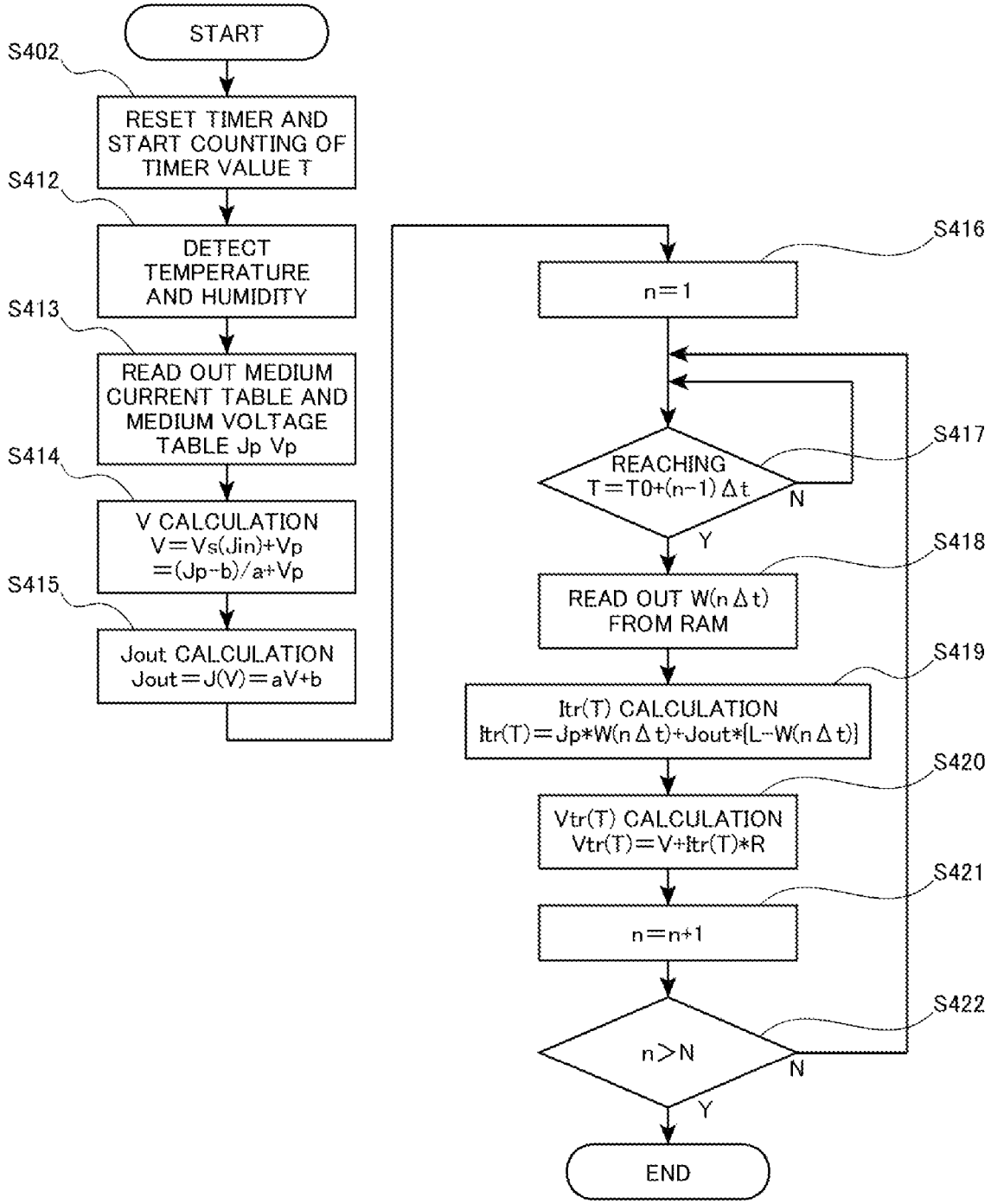
FIG. 20 is a flowchart showing a control method for the secondary transfer voltage according to the second embodiment of the invention.

FIG. 20 is a flowchart showing processing of control method for secondary transfer voltage according to the second embodiment.

The timer 132 is reset (S402), and the controller 53 obtains the sensor signal from the temperature and humidity sensor 69 at the same time as beginning of width detection for the recording medium 141 through the line image sensor 130, thereby obtaining surrounding temperature and surrounding humidity (S412).

The controller 53 looks up the medium current table 120 and the medium voltage table 121 stored in the flash memory 68 and reads out the corresponding medium current value Jp [μA/mm] and medium voltage value Vp [V] based on the obtained surrounding temperature and surrounding humidity (S413).

The controller 53 subsequently calculates the voltage value V [V] and the current density Jout [μA/mm] (S414, S415). The controller 53 herein seeks the voltage value V [V] and the current density Jout [μA/mm] using Formula (9) and Formula (10).

It is to be noted that the voltage value V [V] and the current density Jout [μA/mm] are not depending on the medium region width W. Therefore, those are preferably calculated at one time at S414, S415 in the printing processing using the same recording medium 141.

The controller 53 continues to monitor the timer 132 and begins calculations of the secondary transfer voltage value at a time when passing a time T0 necessary for the recording medium 141 to reach the secondary transfer unit from the line image sensor 130 (S416, S417).

The controller 53 makes an access to the RAM 133 to read out the medium region width W [mm] (S4189, calculates the secondary transfer voltage value to be applied to the medium having the medium region width W [mm], and outputs the calculated secondary transfer voltage value to the secondary transfer bias supplying unit 64 (S418, S420).

The controller 53 sequentially reads out the medium region width W in the number of N stored in the RAM 133 at each of, e.g., Δt [s] after passing time T0 for reaching of the recording medium 141 to the secondary transfer unit from the line image sensor 130.

First, the controller 53 seeks the current Itr [μA] flowing the entire secondary transfer roller 36 according to Formula (13).

$$Itr(T)=Jp*W(n\Delta t)+Jout*\{L-W(n\Delta t)\} \quad \text{Formula (13)}$$

In Formula (13), the current density Jp in the region that the recording medium 141 exists is multiplied by W(nΔt) whereas the current density Jout in the region that no recording medium 141 exists is multiplied by {L−W(nΔt)} because the medium region width W detected from the output video images of the line image sensor 130 (or namely the total value of the widths of the recording medium 141) is set as W(nΔt).

The controller 53 then seeks the voltage Vtr [V] to be outputted at the secondary transfer bias supplying unit 64 in a way as follows (S420).

$$Vtr(T)=V+Itr(T)*R, \text{ providing } T=T0+(n-1)\Delta t \quad \text{Formula (14)}$$

The controller 53 increments the counter value n by one (S421) when passing the prescribed time interval Δt [s]. This is repeated until the counter value n shows n>N (S422). The controller 53 renews the value of the medium region width W at each Δt, and ends supply of the secondary transfer bias when completing the secondary transfer up to the rear end of the recording medium 141.

Thus, with the image forming apparatus, excellent secondary transfer results are obtainable by controlling the secondary transfer voltage in matching the width of the recording medium even where the recording medium has a width continuously changing in the conveyance direction as shown in FIG. 18 as an example.

As described above, according to the second embodiment, the line image sensor 130 measures continuously the width of the recording medium 141, and the output of the secondary transfer bias supplying unit 64 during a period that the recording medium 141 passes by the secondary transfer nipping area is made controllable in a way matching to the width changes of the recording medium 141. Therefore, the image forming apparatus can make excellent secondary transfer over the entire recording medium even where the recording medium is not rectangular but has a width changing during the secondary transfer.

Other Embodiments

Although various modifications are possible in the first embodiment and the second embodiment, this invention is further applicable to other modifications as follows.

In the first embodiment described above, exemplified is a structure having the medium width detection mechanism 101 as means for detecting width of the recording medium. In some image forming apparatuses such as printers or photocopiers, the recording medium to be contained in the recording medium containing cassette can be designated or pre-set. In a case that the type of the recording medium contained in the recording medium containing cassette can be recognized (such as, e.g., A4 size or B5 size, etc.), the controller may obtain information of the types of the set recording medium, and may perform the processing according to the first embodiment described above.

In the second embodiment, where the types of the recording medium such as, e.g., DVD, CD, are recognizable, the controller may obtain information of types of the set recording medium, and may perform the processing according to the second embodiment described above.

In the first and second embodiments, exemplified are the multicolor image forming or recording apparatuses to which this invention applies. This invention is applicable to various apparatuses such as photocopiers, facsimile machines, MFPs, etc. as far as image forming apparatuses using an intermediate transfer method.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An image forming apparatus comprising:

an image forming unit;

an image carrier carrying on a surface thereof a developer image formed by the image forming unit;

a transfer unit for transferring the developer image carried on the image carrier to a recording medium;

a voltage supplying unit for supplying a transfer voltage to the transfer unit;

a transfer current measuring unit for measuring a transfer current value at a time that a prescribed voltage is applied from the voltage supplying unit to the transfer unit in a state that no recording medium exists in the transfer unit;

a resistor serially coupled between the transfer current measuring unit and the transfer unit;

a memory unit for storing electrical character information of the recording medium;

a controller for controlling the transfer voltage supplied from the voltage supplying unit to the transfer unit where the developer is transferred to the recording medium, based on a consequence measured by the transfer current measuring unit, a recording medium width in a widthwise direction in association with the kind of the recording medium, the electrical character information of the recording medium, and a resistance value of the resistor; and a width detection unit for detecting the recording medium width, the width detection unit sequentially detecting the recording medium width changing in a sheet when the recording medium is conveyed, wherein the transfer voltage is determined based on the recording medium width sequentially changing.

2. The image forming apparatus according to claim 1, wherein the transfer current measuring unit measures the transfer current value at least one time after turning on the apparatus before printing operation.

3. The image forming apparatus according to claim 1, wherein the transfer current measuring unit measures a first transfer current value in applying a first prescribed voltage to the transfer unit whereas measuring a second current value in applying a second prescribed voltage different from the first prescribed voltage to the transfer unit.

4. The image forming apparatus according to claim 1, wherein the memory unit stores the electrical character information containing a value changeable according to either or both of temperature and humidity at the image forming apparatus.

5. The image forming apparatus according to claim 1, wherein the memory unit stores the electrical character information in a form of a table.

6. The image forming apparatus according to claim 1, wherein the memory unit stores, as the electrical character information, a recording medium current and a recording medium voltage, actually measured in advance.

7. The image forming apparatus according to claim 1, wherein the memory unit stores the electrical character information including at least two of a voltage value applied to the recording medium, a current value flowing through the recording medium, a resistance value of the recording medium, where the developer image on the image carrier is transferred effectively to the recording medium.

8. The image forming apparatus according to claim 1, further comprising a width detecting unit for sequentially detecting the recording medium width extending in the widthwise direction substantially perpendicular to a conveyance direction of the recording medium conveyed with the transfer unit to provide a detected consequence to the controller.

9. The image forming apparatus according to claim 8, wherein the controller sequentially controls the transfer voltage supplied from the voltage supplying unit, based on the detected consequence from the width detecting unit where the developer image on the image carrier is transferred to the recording medium.

10. The image forming apparatus according to claim 8, wherein the width detecting unit detects a total value of the recording medium widths in a case where the recording medium is existing at two or more locations in the widthwise direction.

11. The image forming apparatus according to claim 10, wherein the width detecting unit detects the total value of the recording medium widths in a case that the recording medium is in a donut shape.

12. An image forming apparatus comprising:

an image forming unit;

an image carrier carrying on a surface thereof a developer image formed by the image forming unit;

a transfer unit for transferring the developer image carried on the image carrier to a recording medium;

a voltage supplying unit for supplying a transfer voltage to the transfer unit;

a transfer current measuring unit for measuring a transfer current value at a time that a prescribed voltage is applied from the voltage supplying unit to the transfer unit in a state that no recording medium exists in the transfer unit; and a controller for controlling the transfer voltage supplied from the voltage supplying unit to the transfer unit according to the transfer current value and a recording medium width in a widthwise direction in association with electrical character information of the recording medium, where the developer is transferred to the recording medium, wherein the transfer voltage is determined according to the recording medium width (W), first current density (Jp) flowing through a medium inside region and second current density (Jout) flowing through a medium outside region, wherein the medium inside region corresponds to a region where the recording medium exists and wherein the medium outside region corresponds to a region where the recording medium is non-existent.

13. The image forming apparatus according to claim 12, wherein the transfer current measuring unit is connected to the transfer unit via a resistor.

14. The image forming apparatus according to claim 12, wherein the electrical character information of the recording medium is stored in advance in a memory unit.

15. The image forming apparatus according to claim 14, wherein the memory unit stores the electrical character information including at least two of a voltage value applied to the recording medium, a current value flowing through the recording medium, a resistance value of the recording medium, where the developer image on the image carrier is transferred effectively to the recording medium.

16. The image forming apparatus according to claim 12, further comprising a width detecting unit for sequentially detecting the recording medium width extending in the widthwise direction substantially perpendicular to a conveyance direction of the recording medium conveyed with the transfer unit to provide a detected consequence to the controller.

17. The image forming apparatus according to claim 16, wherein the controller sequentially controls the transfer voltage supplied from the voltage supplying unit, based on the detected consequence from the width detecting unit where the developer image on the image carrier is transferred to the recording medium.

18. The image forming apparatus according to claim 16, wherein the width detecting unit detects a total value of the recording medium widths in a case where the recording medium is existing at two or more locations in the widthwise direction.

19. The image forming apparatus according to claim 12, wherein the transfer voltage (Vtr) is obtained from the formula:

$$Vtr=V+\{Jp*W+Jout*(L-W)\}*R, \text{ and}$$

wherein V represents voltage applied to the medium inside region, Jp represents current density flowing through the medium inside region, Jout represents current density flowing through the medium outside region, W represents the recording medium width, L represents the recording medium length, and R represents resistance.

20. An image forming apparatus comprising:

an image forming unit;

an image carrier carrying on a surface thereof a developer image formed by the image forming unit;

a transfer unit for transferring the developer image carried on the image carrier to a recording medium;

a voltage supplying unit for supplying a transfer voltage to the transfer unit;

a transfer current measuring unit for measuring a transfer current value at a time that a prescribed voltage is applied from the voltage supplying unit to the transfer unit in a state that no recording medium exists in the transfer unit;

a controller for controlling the transfer voltage supplied from the voltage supplying unit to the transfer unit according to the transfer current value and a recording medium width in a widthwise direction in association with electrical character information of the recording medium, where the developer is transferred to the recording medium; and a width detecting unit for sequentially detecting the recording medium width extending in the widthwise direction substantially perpendicular to a conveyance direction of the recording medium conveyed with the transfer unit to provide a detected consequence to the controller, wherein the width detecting unit detects a total value of the recording medium widths in a case where the recording medium is existing at two or more locations in the widthwise direction, and wherein the width detecting unit detects the total value of the recording medium widths in a case that the recording medium is existing at two or more locations in the widthwise direction, and the recording medium is in a donut shape.

* * * * *